US008348357B2

(12) United States Patent
Briggs

(10) Patent No.: US 8,348,357 B2
(45) Date of Patent: Jan. 8, 2013

(54) DRAWER ASSEMBLY LOCKING MECHANISM

(76) Inventor: Matthew Briggs, Kaysville, UT (US)

( * ) Notice: Subject to any disclaimer, the term of this patent is extended or adjusted under 35 U.S.C. 154(b) by 130 days.

(21) Appl. No.: 12/833,521

(22) Filed: Jul. 9, 2010

(65) Prior Publication Data

US 2011/0031859 A1 Feb. 10, 2011

Related U.S. Application Data

(60) Provisional application No. 61/224,869, filed on Jul. 12, 2009.

(51) Int. Cl.
*E05B 53/00* (2006.01)

(52) U.S. Cl. ..... 312/218; 312/219

(58) Field of Classification Search ..... 312/216, 312/217, 218, 222, 330.1, 333, 107.5, 219–221; 70/78–86, 208, 210; 292/DIG. 31
See application file for complete search history.

(56) References Cited

U.S. PATENT DOCUMENTS

| | | | | | |
|---|---|---|---|---|---|
| 2,944,864 | A * | 7/1960 | Krivulka | 312/332.1 |
| 3,993,338 | A * | 11/1976 | Cherbourg et al. | 292/336.3 |
| 4,006,951 | A * | 2/1977 | Geer et al. | 312/332.1 |
| 4,447,098 | A * | 5/1984 | Parker | 312/216 |
| 4,616,890 | A * | 10/1986 | Romick | 312/265.1 |
| 4,693,503 | A * | 9/1987 | Bisbing | 292/210 |
| 4,966,423 | A * | 10/1990 | Higuera et al. | 312/221 |
| 5,056,877 | A * | 10/1991 | Westwinkel | 312/221 |
| 5,303,994 | A * | 4/1994 | Elsholz | 312/221 |
| 5,931,548 | A * | 8/1999 | Bischoff | 312/221 |
| 5,984,382 | A * | 11/1999 | Bourne et al. | 292/113 |
| 5,997,114 | A * | 12/1999 | Bischoff | 312/215 |
| 6,254,205 | B1 * | 7/2001 | Wright et al. | 312/217 |
| 6,409,290 | B1 * | 6/2002 | Lin | 312/219 |
| 6,450,596 | B1 * | 9/2002 | Lee | 312/217 |
| 6,523,870 | B2 * | 2/2003 | Schlack | 292/336.3 |
| 6,547,289 | B1 * | 4/2003 | Greenheck et al. | 292/126 |
| 6,568,771 | B2 * | 5/2003 | Gentili et al. | 312/221 |
| 6,634,726 | B1 * | 10/2003 | Slivon | 312/221 |
| 6,722,167 | B1 * | 4/2004 | Hsu | 70/78 |
| 7,318,532 | B1 * | 1/2008 | Lee et al. | 211/26 |
| 7,360,802 | B2 * | 4/2008 | Schlack et al. | 292/75 |
| 7,458,651 | B1 * | 12/2008 | Radke et al. | 312/333 |
| 7,823,992 | B2 * | 11/2010 | Chen et al. | 312/221 |
| 2003/0141790 | A1 * | 7/2003 | Weng | 312/217 |
| 2004/0016272 | A1 * | 1/2004 | McCracken et al. | 70/210 |
| 2004/0100165 | A1 * | 5/2004 | Hoffman | 312/219 |
| 2005/0218760 | A1 * | 10/2005 | Cheng | 312/333 |
| 2009/0102333 | A1 * | 4/2009 | Weng | 312/222 |

* cited by examiner

*Primary Examiner* — Janet M Wilkens
*Assistant Examiner* — Hiwoot Tefera
(74) *Attorney, Agent, or Firm* — TraskBritt, P.C.

(57) ABSTRACT

A cabinet is fitted with a locking assembly suited for simultaneously locking or unlocking all of the drawers retained within the cabinet assembly. The locking assembly includes a primary actuation assembly, accessible from the exterior of the cabinet which engages a secondary actuation assembly. The secondary actuation assembly defines a plurality of lip elements which are displaceable intermediate the glide assembly which is associated with each drawer of the cabinet. In a closed, locked condition the lip elements are displaced in front of the glide elements thereby forming an obstacle to the lateral displacement of the glide assembly thereby precluding the outward withdrawal of the drawer from its retained position within the cabinet. In an open position, the lip elements are displaced to a position outside of the travel path of the glide assembly whereby they do not impede the operation of those glide assemblies.

12 Claims, 6 Drawing Sheets

DRAWER ASSEMBLY LOCKING MECHANISM

This application claims the benefit under 35 USC 119(e) of U.S. Provisional Application No. 61/224,869 filed 12 Jul. 2009, the entire contents of which are hereby incorporated by reference.

FIELD

This invention relates to drawer assemblies of the type typically found in cabinets. The invention is particularly directed to drawers for use in cabinets adapted for use in storing articles, e.g. tools, and other articles which are relatively heavy.

STATEMENT OF THE ART

Conventional drawer fitted cabinets typically include a cabinet frame which defines a plurality of recesses. Each recess is configured and dimensioned to receive and retain a respective drawer. A common configuration defines a recess having a quadrilateral cross section which is generally constant over the length of the recess. A drawer, constructed to be received in such a recess, generally includes a planar floor element. A common floor element is rectangular in shape having a planar upper as well as lower surface. The floor element defines two side perimeters, positioned opposite from one another. These side perimeters are linear in construction. The floor element also defines a front perimeter and a rear perimeter. The front and rear perimeters are positioned opposite from one another, each of these latter perimeters are also linear in configuration. The side perimeters each intersect the front perimeter and their rear perimeter at right angles.

Four upstanding sidewalls are positioned about the perimeter of the floor element. Each of the sidewalls may be formed by a planar panel having a generally rectangular shape. Each of the ends of a sidewall is coupled with the end of an adjacently positioned sidewall, typically forming a right angle. The sidewalls extend vertically upright thereby forming a quadrilaterally configured frame which extends upwardly from the horizontally positioned floor element. The drawer may be fitted with a guide or guidance structure adapted to retain the drawer in a preselected travel path as the drawer is pulled outwardly from the recess or pushed back into the recess from a withdrawn condition.

Drawers of the conventional construction are oftentimes utilized to secure articles from being accessed by unauthorized individuals. To this end, drawers are oftentimes equipped with one or more locking mechanisms which are designed to restrict access to the contents to the drawer. A conventional locking mechanism may include a key actuated tumbler mechanism, mounted within the body of the drawer, which operates to displace an outwardly extending latch into a locking engagement with the frame of a cabinet housing the drawer. In a common construction, each drawer is fitted with a respective locking mechanism which permits the user to open one drawer while retaining the remainder of the drawers in a locked condition.

In many industrial environments, it is desirable to have a cabinet assembly in which a single locking mechanism can be actuated to facilitate access to all of the drawers of a cabinet. Furthermore, in such environments, it is also desirable to provide a cabinet whose construction and operation is substantially immune to the presence of dirt, grease or other contaminants which may otherwise preclude the operation of conventional locking mechanisms.

SUMMARY OF THE INVENTION

In a cabinet structure having at least one drawer assembly, the invention provides a drawer locking mechanism. The drawer assembly, being displaceable, has a guide associated therewith. The drawer locking mechanism includes a primary actuation element secured to the cabinet. The primary actuation element is positionable between a locked condition and an unlocked condition. A secondary actuation element is slidably mounted in the cabinet for displacement, preferably a linearly directed displacement. The secondary actuation element has at least one blocking element configured for engagement with the guide of the drawer, in the locked condition, for precluding a displacement of the guide and a resulting preclusion of a displacement of the drawer associated with the guide. The primary actuation element is operably associated with the secondary actuation element for displacing the secondary actuation element between an open condition and a closed condition.

The locking mechanism may be adapted for use with cabinet structures which define a multiplicity of drawer assemblies. In these particular embodiments, the secondary actuation element is configured to have one or more blocking elements which engaged with one or more, and preferably all of the drawer assemblies whereby the user may lock or alternatively render accessible all of the drawer assemblies by a single actuation or displacement of the secondary actuation element.

DETAILED DESCRIPTION OF THE ILLUSTRATED EMBODIMENT

Figure 1:
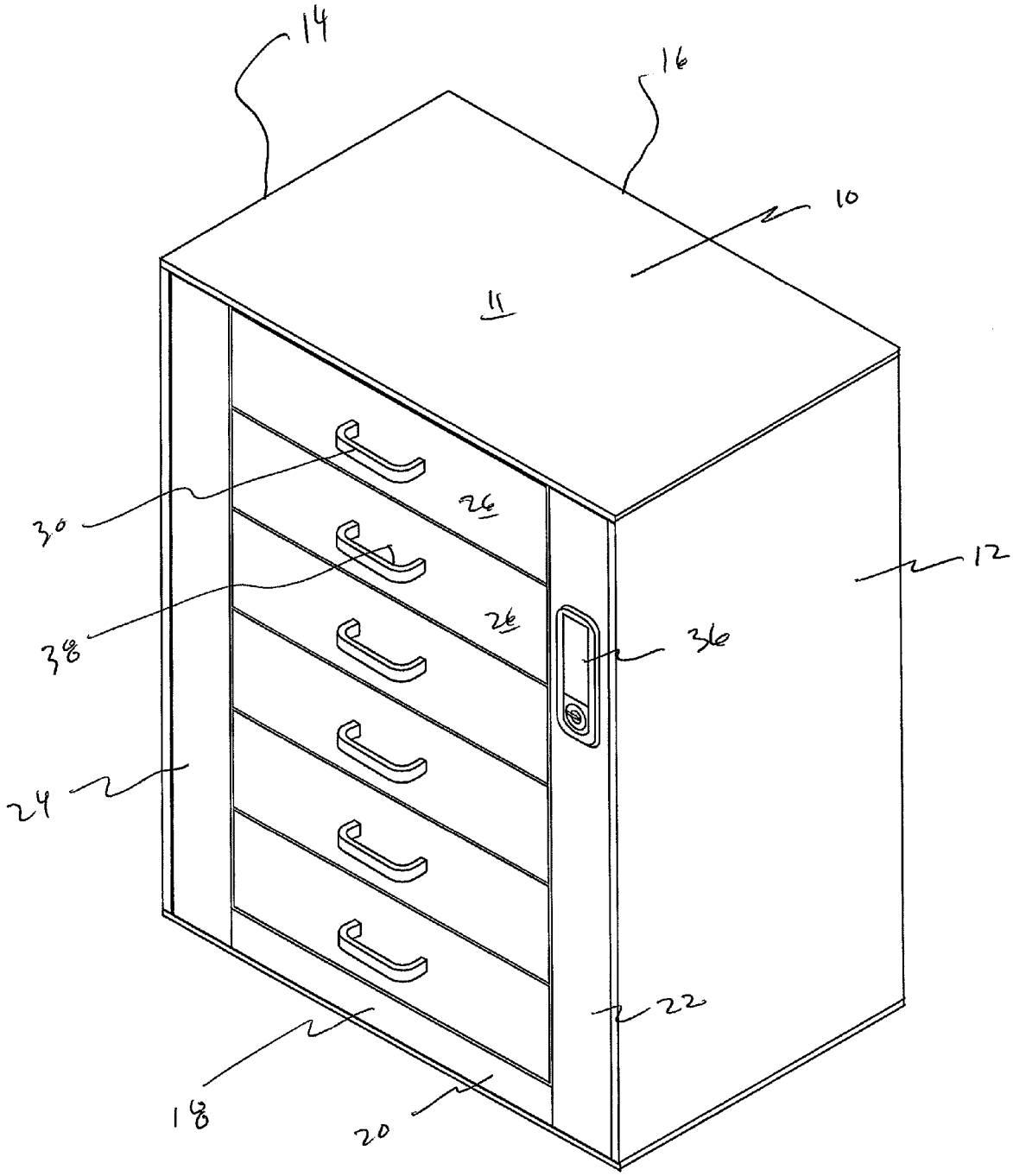
FIG. 1 is a perspective view of a cabinet and drawer assembly fitted with an embodiment of a drawer locking mechanism of the invention.

As shown in FIG. 1 a cabinet and drawer assembly 10 of the invention includes a planar element 11 which is joined on its side perimeter edges with a pair of upstanding planar sidewall elements 12 and 14. The rear perimeter edge of the top element 11 is secured to a rear element 16. The bottom edge of each of the two sidewall elements 12 and 14 as well as the bottom edge of the rear element 16 are secured to a bottom element 18 to form a generally rectangularly shaped boxlike structure. Disposed within the interior of the cabinet are a pair of support structures 22 and 24 which a spacedly positioned from one another. As shown to advantage in FIG. 1 the support structure 22 is disposed proximate or adjacent the sidewall 12 while the other support structure 24 is disposed proximate or adjacent the sidewall 14. As further illustrated in FIG. 3 the support element 22, and similarly the support element 24 includes a facing element 81 which is secured to a side element 70. The side element associated with the facing element 24 is essentially a mirror image of the side element 70 shown in FIG. 3. The facing element 81 includes a face panel which forms a portion of the front surface of the cabinet as shown in FIG. 1, the facing element is bent approximately ninety degrees proximate its lateral edge to form a lip or mounting plate which may abut against the interior surface of the sidewall element 12 and form a means for securing the facing element to the sidewall 12, e.g. by welding or other form of securement. As shown, the lip extends generally over the entire height of the facing element 81. Positioned within the body of the facing element 81 is a primary actuation mechanism 36. The primary actuation mechanism is retained within an aperture defined within the body of the facing structure 81 and is secured therein by conventional means, e.g. welding, compression fit, screws, etc.

The facing structure 81 is secure side element 70 by conventional means, e.g. welding, adhesives, or mechanical connectors. The side element 70 defines a lip 88 on its upper edge which includes a planar surface which is disposed approximately ninety degrees from the surface of the side element 70. The lip 88 of the side element is positioned to engage the interior surface of the top element 11 and provide a means of securing the side element 70 to the top element, e.g., by welding or some other conventional connection structure. The side element 70 may likewise include a similar lip formed on its bottom surface, (not shown) for purposes of securing the side element to the bottom element 18. Likewise, the rear upright edge of the side element may be configured to define a lip which is dimensioned and disposed to form a means of securing the side element 70 to the interior surface of the rear element 16.

Figure 4:
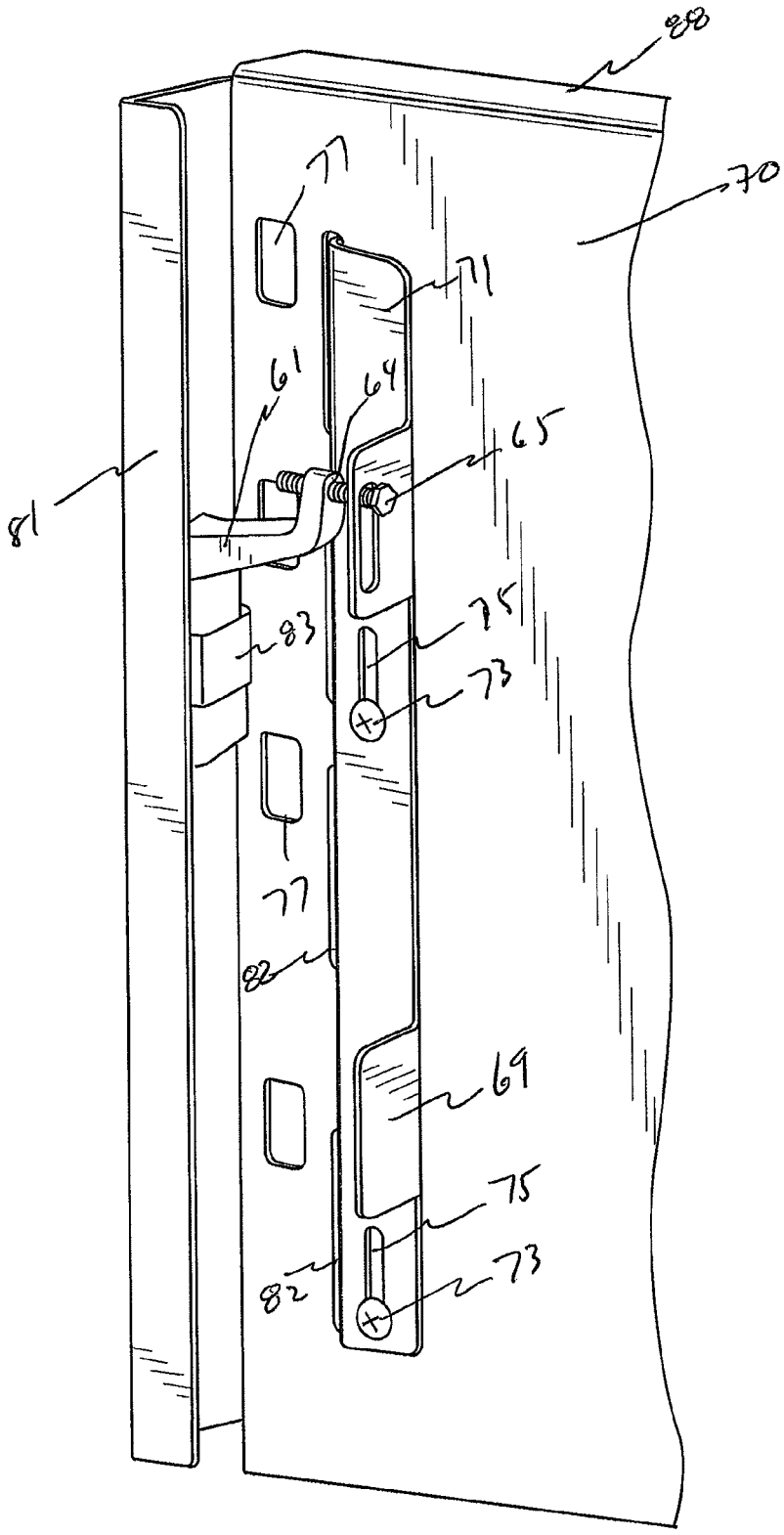
FIG. 4 is a partial perspective view of the cabinet and drawer assembly of FIG. 3 with the locking mechanism being shown in a locked condition.

The side element 70 defines a plurality of slots 77 which extend through the thickness of the side element and are arranged generally vertically over a height of the side element proximate the juncture of the side element and the facing element 81. Within the body of the side element 70 and disposed proximate the slots 77 are a series of elongate slots 82, (see FIG. 4) which are arranged vertically along a common vertical axis over a height of the side element 70. A secondary actuation element 71 having an elongated body and a series of lip elements 84 which are arranged spacedly along the length of the elongated body to extend outwardly from the body of the element 71 at an angle of approximately ninety degrees from the surface of the elongate portion of the element 71. (See FIG. 5). The secondary actuation element 71 defines a series of elongate slots 75 within the body thereof. As shown in FIG. 4, these slots 75 are arranged spacedly from one another and vertically about a common vertical axis. Positioned within each slot 75 is a screw or bolt 73 having a head which is dimensionally larger than the width of its respective slot 75. The elongate shaft of the screw or bolt 73 forms a guide for the secondary actuation element 71 whereby that element 71 may slide upwardly and downwardly relative to the sidewall 70 as the screws 73 restrain that displacement due to their interaction with the sidewalls of their respective slots 75.

Figure 3:
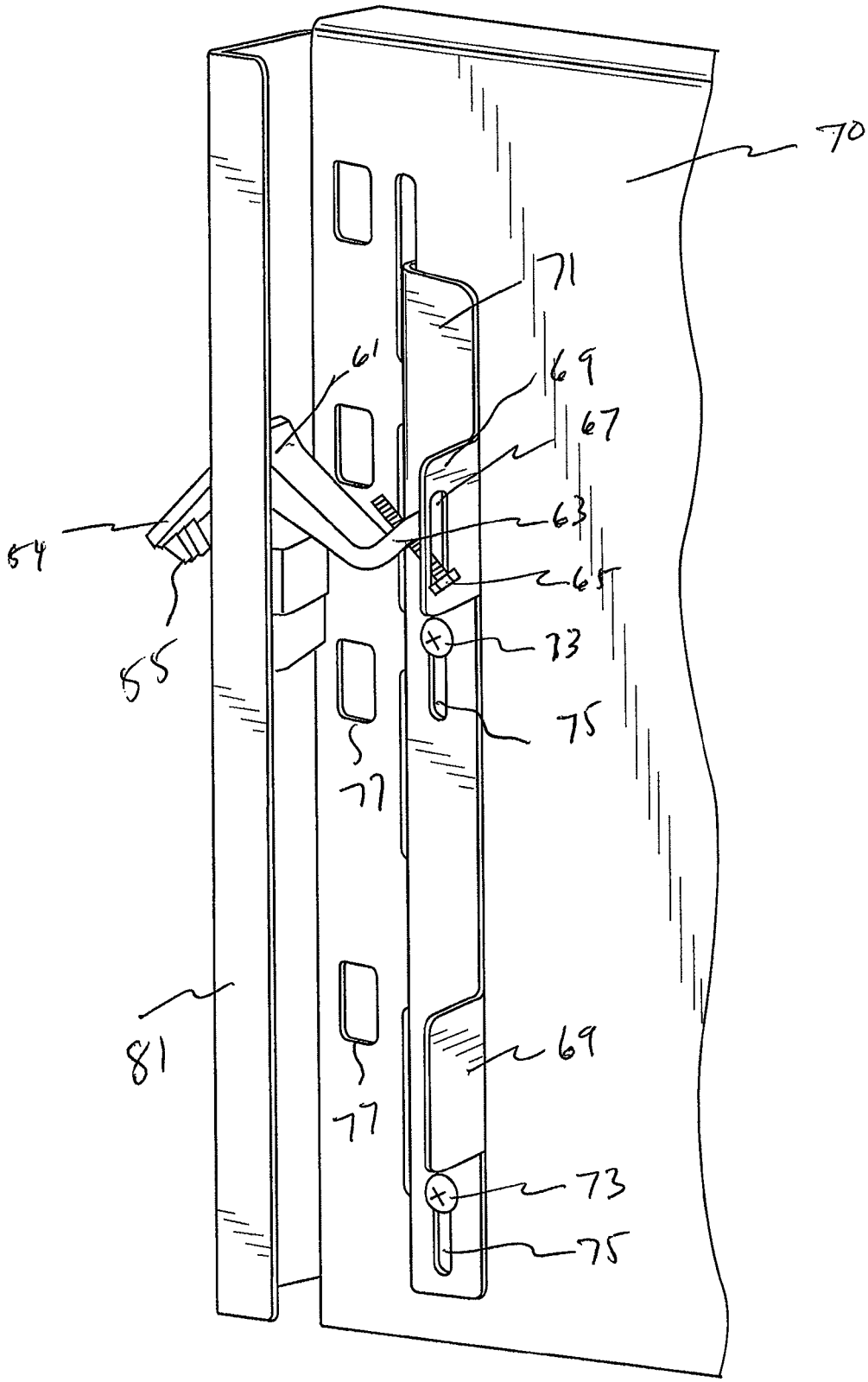
FIG. 3 is a partial perspective view of the cabinet and drawer assembly of FIG. 1 with the side of the cabinet having been removed for clarity, the locking mechanism being shown in an unlocked condition.
Figure 5:
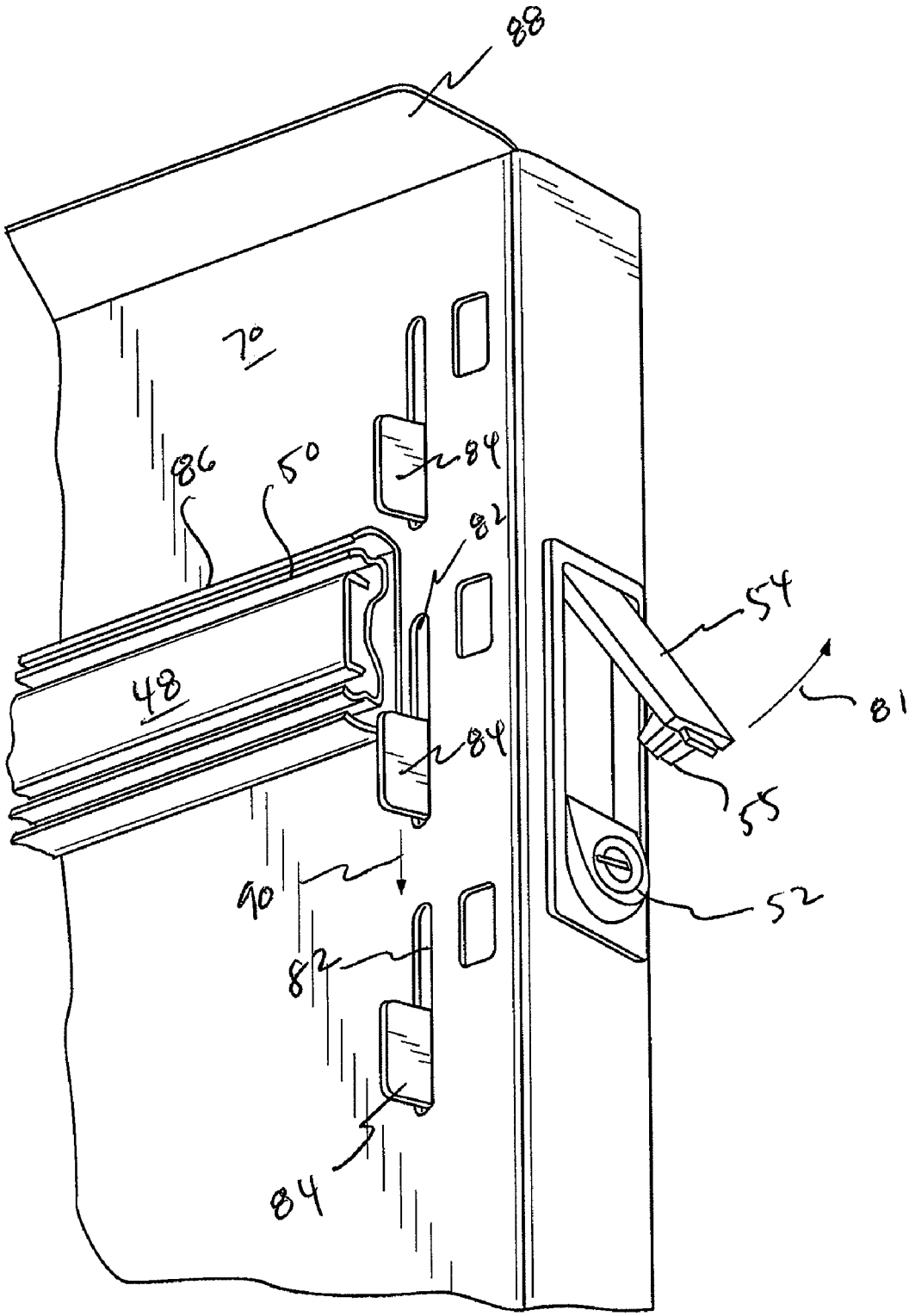
FIG. 5 is a partial perspective sectional view of the front of the cabinet and drawer assembly with the primary actuation mechanism shown in an open condition.

The secondary actuation element 71 also defines one or more extensions 69 which extend outwardly from the elongate portion of the element 71, preferably at an angle of approximately ninety degrees as shown in FIG. 3. At least one of the extensions 69 defines an elongate slot 67 therein which is oriented with its longitudinal axis disposed vertically. A threaded bolt 65 is positioned within the slot 67 such that the head of the bolt, which has a diameter which dimensionally exceeds the width of the slot 67 positioned on one side of the slot while the threaded portion of the bolt 65 extends through the slot 67 and is threadedly received within a threaded aperture defined within an arm 63 of the primary actuation element 61. The primary actuation element 61 is pivotally secured to the facing element 81 to thereby pivot about a horizontal axis. A second arm 54 of the primary actuation element extends outwardly from the cabinet assembly when the primary actuation element is in an open condition. The end of the second arm 54 is fitted with an engagement element 55 which is configured to engage and form a releasable union with a locking assembly 52 which may include a conventional tumbler, key lock assembly as shown in FIG. 5. The engagement assembly 55 is configured to engage with the locking assembly 52 within the housing 83. The combination of the locking assembly 52 and the engagement element 55 are positionable in two conditions, a first unlocked condition as shown in FIG. 3 and a locked condition wherein the element 55 is secured together with the locking assembly 52 as shown in FIG. 4.

Figure 6:
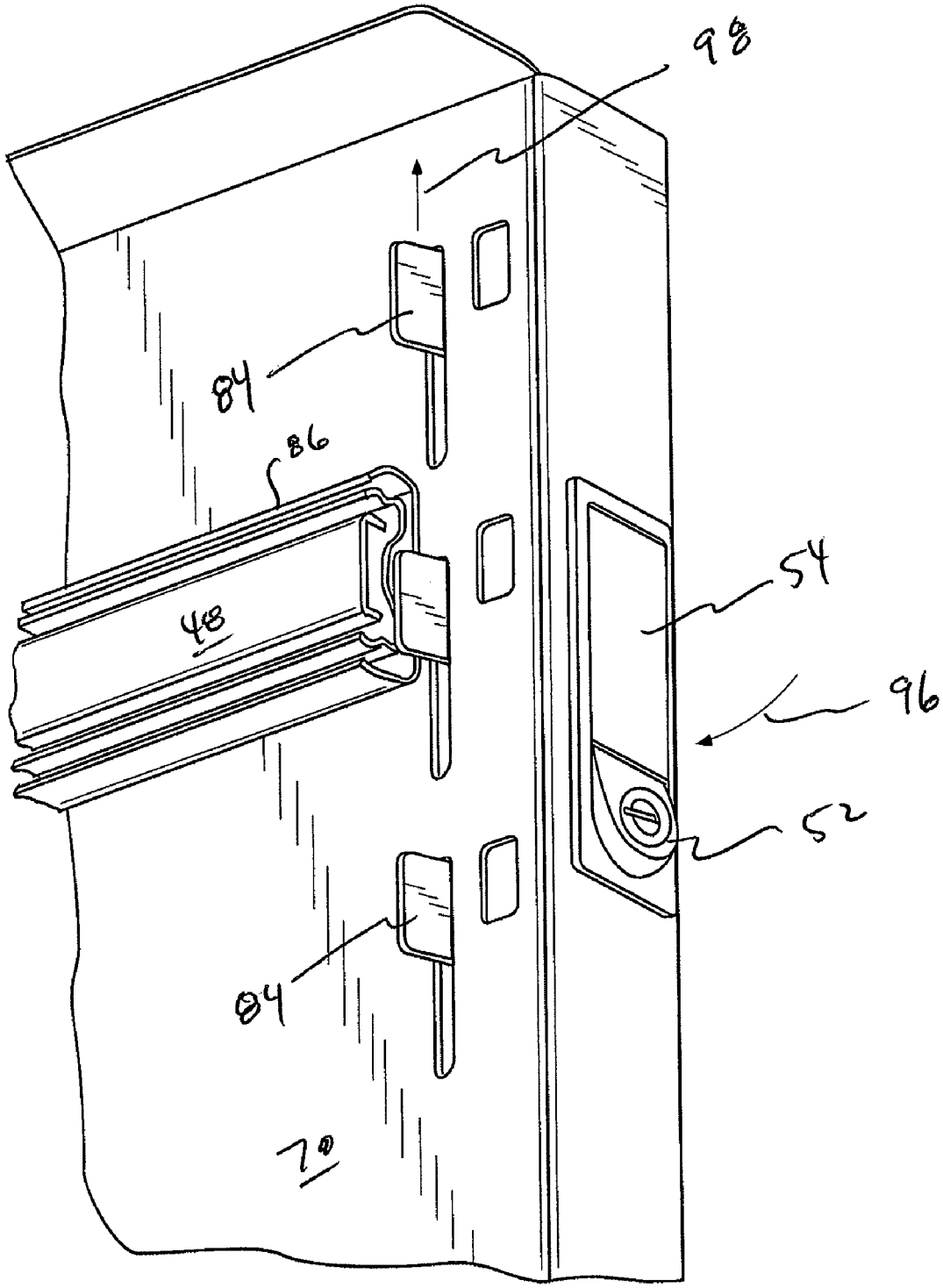
FIG. 6 is a partial perspective sectional view of the front of the cabinet and drawer assembly with the primary actuation mechanism shown in a closed condition.

As the primary actuation assembly 61 is rotated about its horizontal axis in a counterclockwise direction, the threaded bolt 65 is likewise rotated counterclockwise by its association with the first arm 63 about the axis of the primary actuation assembly 61 thereby bringing the bolt 65 into engagement with the upper perimeter of the slot 67. As the bolt 65 engages the upper edge of that slot, the secondary actuation assembly 71 is displaced upwardly by the bolt 65. This in turn causes the lips 84 to be driven upwardly through their respective slots 82. Whereas the lips 84 may initially have been positioned in the lowermost portion of their respective slots 82 as shown in FIG. 5, as the bolt 65 is rotated upwardly, the lips 84 are driven upwardly until eventually there are positioned as shown in FIG. 6, with the upper portion of each lip 84 abutting against the upper edge of its respective slot 82. Similarly, upon a clockwise rotation of the primary actuation element 61 about its horizontal axis, the bolt 65 is driven downwardly as it engages the lower perimeter of its respective slot 67; it pushes the secondary actuation element 71 downwardly causing that element 71 to be displaced downwardly. This downward displacement causes the lips 84 to be simultaneously driven downwardly as well eventually culminating with the lips 84 coming into abutment with the lower edge of their respective slot 82 as shown in FIG. 5.

Secured to the interior surface of both of the sidewalls 70 is a conventional drawer glide assembly. As shown in FIG. 5, this glide assembly includes a mounting bracket 86 which is fixedly secured to the interior surface of the sidewall 70. A first glide element 50 is displaceably secured to the mounting bracket 86 to be laterally displaceable along the bracket 86. The first guide element may be secured to the mounting bracket by a series of rotatable wheels which are retained within a track defined within the body of the mounting bracket 86. A second glide element 48 is displaceably secured to the first glide element 50. The second glide element 48 is adapted to be laterally displaced relative to the first glide element 50. Glide assemblies are well known in the art and any of the various configurations of such glide elements may be utilized in the construction of the instant invention. In a closed orientation, the two glide elements are nested one within the other as shown in FIG. 5. Further the two glide elements 48 and 50 are nested within the mounting bracket as shown. The second glide element 48 is secured to the respective sidewall 55 of a drawer 26. The drawer 26 may be formed of a bottom 46, having a pair of sidewall 42 and 44 which extend uprightly from the opposed side perimeters of the bottom 46 and a front side wall 40 which extends uprightly from the front edge or perimeter of the bottom 46. A rear side wall may also extend uprightly from the rear perimeter or edge of the bottom surface 46. A handle 30 may be secured to the outer surface of the front side wall as shown to advantage in FIG. 2.

The glide assembly is secured to the outer surface of a respective sidewall 44 or 42 to extend along a portion of a length of that sidewall. In preferred constructions, the glide assembly is oriented approximately midway between the top edge of the side wall and its bottom edge. As further shown in FIG. 2, as the drawer is pulled outwardly from its closed retained position within the cabinet assembly 11, the second glide 48, due to its securement to the sidewall 44 follows the drawer and is displaced outwardly with the drawer sidewall. Furthermore, upon a given displacement of the second glide element 48, the first glide element 50 is engaged by the second glide element and it too is displaced outwardly along the laterally defined direction of travel of the glide elements. The second glide element 48 may include an engagement member which engages against the first glide element upon a predetermined outward displacement of the second glide element which then causes the first glide element 50 to be drawn outwardly with the second glide element as the drawer is pulled outwardly from its retained position within the cabinet. It should be appreciated that the depiction of the relationship of the glide element with the sidewall 44 is essentially duplicated in a mirror image on the opposing sidewall 42.

Figure 2:
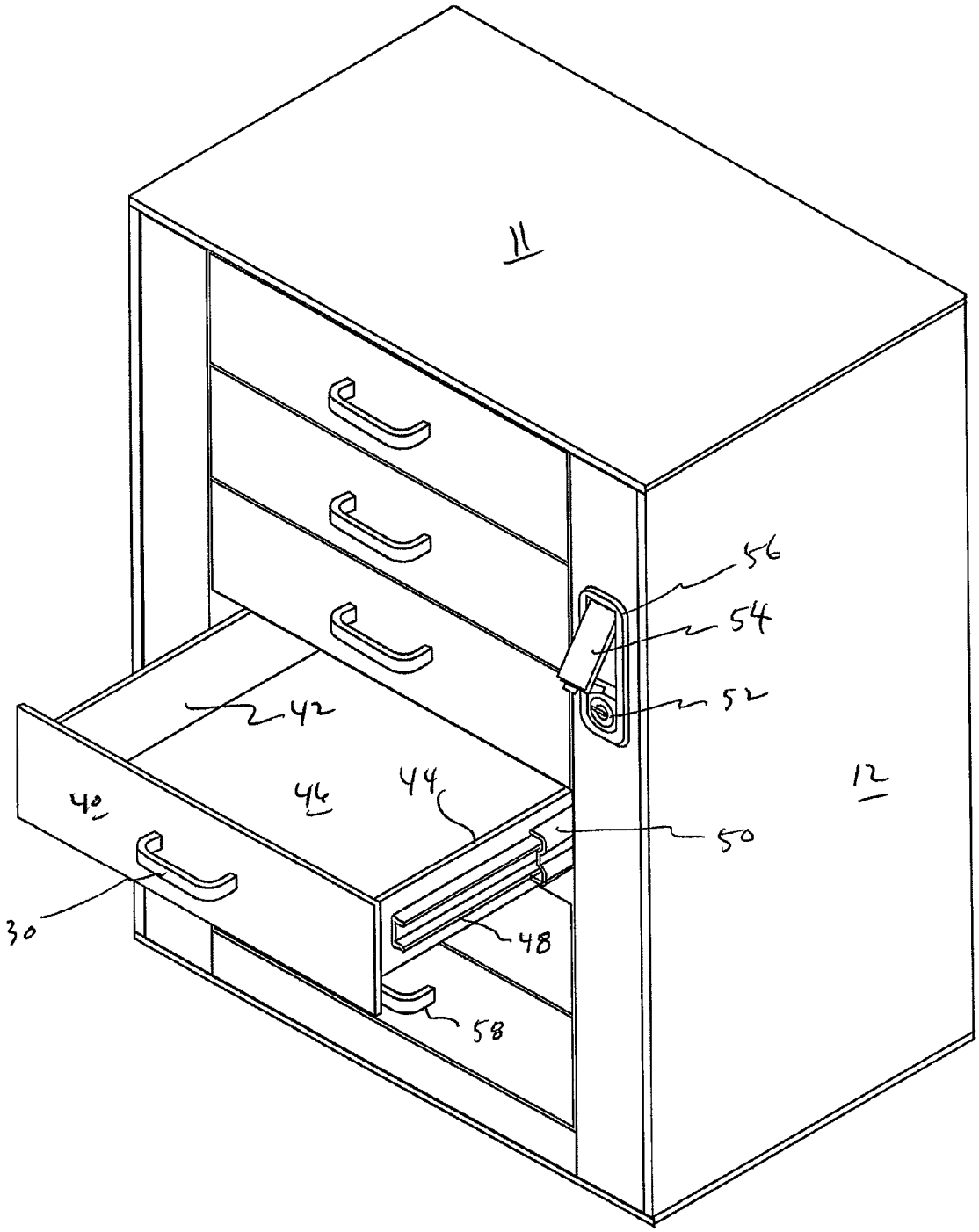
FIG. 2 is a perspective view of the cabinet and drawer assembly of FIG. 1 with one of the drawers being shown in an open condition.

As illustrated in FIGS. 5 and 6, the glide assembly is positioned spacedly from the front edge of the cabinet 11 The slots 82 are positioned intermediate the front most or forward most portion of the glide assemblies, in a closed condition, and the front of the cabinet 11. Given this relative orientation of the front of the glide assemblies and the slots 82, it follows that the lips 84 may be positioned intermediate the glide assemblies and the front of the cabinet by a suitable displacement of the secondary actuation assembly. As shown to advantage in FIG. 5, when the drawers 26 are in a closed condition, the glide assemblies are physically positioned toward the rear of the cabinet behind the slots 82. With the lips 84 being positioned in the open condition as shown in FIG. 5, the drawers 26 may be pulled outwardly from their retained position within the cabinet 11 as shown in FIG. 2. The lips 84 are positioned elevationally below the travel path of the glide assemblies such that the glide assemblies may pass above the lips 84 without hindrance. In the orientation shown in FIG. 6, the secondary actuation assembly has been repositioned into a closed or locked orientation. This orientation, which is obtained by rotating the primary actuation assembly clockwise about its horizontal axis thereby displacing the secondary actuation assembly upwardly, causes the lips 84 to be driven upwardly to the position shown in FIG. 6. In this orientation the lips 84 define a barrier or obstruction to the lateral displacement of the glide assemblies. As can be observed from FIG. 6, any forwardly directed motion of the second glide assembly 48 would be impeded by the lip 84 positioned in front of that element. A lip 84 and its associated slot 82 may be disposed intermediate the glide assembly for one or more of the drawers retained within the cabinet 11. In preferred constructions, such a lip 84 and associated slot 82 construction is provided for each drawer within the cabinet assembly. In this preferred construction, the user is able to lock or unlock all of the drawers in one single operation by rotating the primary actuation assembly as previously described.

Once the primary actuation assembly has been positioned into the closed condition shown in FIG. 6, the user may actuate the lock assembly 52 to secure the cabinet thereby precluding a third party from accessing the contents of the drawers of the cabinet by rotating the primary actuation assembly.

It should be appreciated that the above description of the instant invention is illustrative of the invention and is not intended to be restrictive of the scope of the invention which is solely determined by the claims which are appended hereto

The invention claimed is:

1. A drawer assembly including a locking mechanism, the drawer assembly comprising:

a cabinet comprising a plurality of laterally displaceable drawers, each drawer movably coupled to the cabinet with a first drawer guide coupled to a first lateral sidewall of the drawer and a second drawer guide coupled to a second lateral sidewall of the drawer opposing the first lateral sidewall;

a primary actuation element secured to a face of the cabinet proximate a front side wall of at least one drawer of the plurality of laterally displaceable drawers, said primary actuation element being pivotably coupled to the cabinet and being displaceable between a locked condition and an unlocked condition, wherein, in the locked condition, the primary actuation element is substantially flush with the face of the cabinet, and wherein, in the unlocked condition, the primary actuation element extends outwardly from the face of the cabinet; and a secondary actuation element slidably mounted in said cabinet for vertical displacement and coupled to the primary actuation element for displacing the secondary actuation element between an open condition when the primary actuation element is positioned in the unlocked condition and a closed condition when the primary actuation element is positioned in the locked condition, said secondary actuation element comprising a plurality of blocking elements, each blocking element of the plurality of blocking elements being associated with one drawer of the plurality of drawers, wherein, in the closed condition, each blocking element of the plurality of blocking elements is positioned directly in a path of at least one drawer guide of the first and second drawer guides of the associated one drawer to block movement of the least one drawer guide when the primary actuation element is positioned in said locked condition to preclude displacement of the at least one drawer guide of each drawer of the plurality of drawers and a resulting displacement of each drawer of the plurality of drawers in the cabinet, and wherein, in the open condition, each blocking element of the plurality of blocking elements is positioned out of the path of the at least one drawer guide of the associated one drawer to enable movement of each drawer of the plurality of drawers when the primary actuation element is positioned in the unlocked position, wherein the primary actuation element is a lever pivotally coupled to the cabinet, wherein a coupling between the lever and the secondary actuation element is adjustable, wherein an end of the lever is adjustable in length to form the adjustable coupling between the lever and the secondary actuation element, wherein the end of the lever is formed by a threaded member that is threadedly inserted into a threaded aperture formed on the body of the lever, the threaded member being threadedly insertable into the threaded aperture and threadedly retractable from the threaded aperture to adjust the length of the lever.

2. The drawer assembly of claim 1, wherein the plurality of blocking elements of the secondary actuation element each comprise a tab extending outwardly from a body of the secondary actuation element, wherein the body of the secondary actuation element is slidably coupled to a front portion of the cabinet.

3. The drawer assembly of claim 2, wherein secondary actuation element is slidably mounted in a vertically extending slot.

4. The drawer assembly of claim 1, wherein a portion of said threaded member is received within a vertically extending slot defined within said secondary actuation element.

5. The drawer assembly of claim 4, wherein said secondary actuation element is mounted within a vertically extending slot defined in said cabinet.

6. A drawer assembly including a locking mechanism, the drawer assembly comprising:

a cabinet;

a plurality of drawers disposed within said cabinet for lateral movement into and out of said cabinet, each drawer of the plurality of drawers being movably coupled to the cabinet with a first drawer guide coupled to a first lateral sidewall of the drawer and a second drawer guide coupled to a second lateral sidewall of the drawer opposing the first lateral sidewall;

a primary actuation element secured to said cabinet, said primary actuation element being displaceable between a locked condition and an unlocked condition; and a secondary actuation element slidably mounted in said cabinet for vertical displacement, said secondary actuation element having a plurality of blocking elements each configured for engagement with at least one drawer guide of the first drawer guide and second drawer guide coupled to one drawer of the plurality of drawers, wherein, in said locked condition, each blocking element is positioned within a path of the at least one drawer guide of each drawer of the plurality of drawers to preclude displacement of each drawer of the plurality of drawers by blocking displacement of the at least one drawer guide, wherein said primary actuation element is operably associated with said secondary actuation element for displacing said secondary actuation element between an open condition and a closed condition, wherein:

the primary actuation element is a lever pivotally coupled to the cabinet;

an end of the lever is adjustable in length;

a coupling between the lever with the secondary actuation element is adjustable by the adjustable end of the lever; and the end of the lever is formed by a threaded member which is threadedly inserted into a threaded aperture formed on the body of the lever, the threaded member being threadedly insertable into the threaded aperture and threadedly retractable from the threaded aperture to adjust the length of the lever.

7. The drawer assembly of claim 6, wherein said primary actuation element is manually accessible from outside of said cabinet.

8. The drawer assembly of claim 6, wherein secondary actuation element is slidably mounted in a vertically extending slot.

9. The drawer assembly of claim 6, wherein a portion of said threaded member is received within a vertically extending slot defined within said secondary actuation element.

10. The drawer assembly of claim 9, wherein said secondary actuation element is mounted within a vertically extending slot defined in said cabinet.

11. A drawer assembly including a locking mechanism, the drawer assembly comprising:

a cabinet comprising a plurality of laterally displaceable drawers, each drawer movably coupled to the cabinet with a first drawer guide coupled to a first lateral sidewall of the drawer and a second drawer guide coupled to a second lateral sidewall of the drawer opposing the first lateral sidewall;

a lever secured to a face of the cabinet proximate a front side wall of at least one drawer of the plurality of laterally displaceable drawers, the lever being pivotably coupled to the cabinet and being displaceable between a locked condition and an unlocked condition; and a secondary actuation element comprising a plurality of tabs extending outwardly from a body of the secondary actuation element the body of the secondary actuation element being slidably coupled to the cabinet, the body of the secondary actuation element being coupled to the lever such that, when the lever is positioned in the unlocked condition, the body of the secondary actuation element is positioned in an open condition and, when the lever is positioned in the locked condition, the body of the secondary actuation element is positioned in a closed condition, wherein:

each tab of the plurality of tabs is associated with one drawer of the plurality of drawers;

in the closed condition, each tab of the plurality of tabs are positioned directly in a path of at least one drawer guide of the first and second drawer guides coupled to the associated drawer to block movement of the least one drawer guide to preclude displacement of the associated one drawer;

in the open condition, the plurality of tabs are each positioned out of the path of the at least one drawer guide of the associated one drawer to enable movement of each drawer of the plurality of drawers and the corresponding at least one drawer guide;

an end of the lever is adjustable in length;

the coupling between the lever with the secondary actuation element is adjustable by the adjustable end of the lever; and the end of the lever is formed by a threaded member which is threadedly inserted into a threaded aperture formed on the body of the lever, the threaded member being threadedly insertable into the threaded aperture and threadedly retractable from the threaded aperture to adjust the length of the lever.

12. The drawer assembly of claim 11, further comprising a locking assembly, wherein the locking assembly selectively prohibits the lever from moving into the unlocked condition.

* * * * *

UNITED STATES PATENT AND TRADEMARK OFFICE

CERTIFICATE OF CORRECTION

PATENT NO. : 8,348,357 B2
APPLICATION NO. : 12/833521
DATED : January 8, 2013
INVENTOR(S) : Matthew Briggs It is certified that error appears in the above-identified patent and that said Letters Patent is hereby corrected as shown below:

In the claims:

CLAIM 3, COLUMN 7, LINE 10, change “wherein secondary” to --wherein said secondary--

CLAIM 8, COLUMN 8, LINE 1, change “wherein secondary” to --wherein said secondary--

CLAIM 11, COLUMN 8, LINE 39, change “the least” to --the at least--

Signed and Sealed this
Eighth Day of September, 2015

Michelle K. Lee

Michelle K. Lee
*Director of the United States Patent and Trademark Office*